US007194971B2

(12) United States Patent
Stolzer

(10) Patent No.: US 7,194,971 B2
(45) Date of Patent: Mar. 27, 2007

(54) LIFT ARRANGEMENT FOR BOATS

(75) Inventor: Armin Stolzer, Nierstein (DE)

(73) Assignee: Keuro Besitz GmbH & Co. EDV - Dienslleistungs KG, Achern (DE)

( * ) Notice: Subject to any disclaimer, the term of this patent is extended or adjusted under 35 U.S.C. 154(b) by 0 days.

(21) Appl. No.: 11/332,450

(22) Filed: Jan. 13, 2006

(65) Prior Publication Data

US 2006/0180069 A1 Aug. 17, 2006

(30) Foreign Application Priority Data

Jan. 13, 2005 (EP) ..... 05 000 578

(51) Int. Cl.
*B63C 7/00* (2006.01)

(52) U.S. Cl. ..... 114/44; 405/3

(58) Field of Classification Search ..... 114/44, 114/263; 405/3, 4, 7
See application file for complete search history.

(56) References Cited

U.S. PATENT DOCUMENTS 3,045,839 A * 7/1962 Hibberd ..... 114/44
3,252,589 A * 5/1966 Keene et al. ..... 114/263
3,385,458 A 5/1968 Gresham
4,953,488 A 9/1990 Heidtmann
5,593,247 A * 1/1997 Endres et al. ..... 405/3
5,947,639 A * 9/1999 Bishop et al. ..... 405/3
6,007,288 A 12/1999 Maffett et al.
6,152,065 A * 11/2000 Gronstrand ..... 114/44

FOREIGN PATENT DOCUMENTS

| | | | |
|---|---|---|---|
| DE | 39 37 097 | 5/1990 | |
| DE | 100 45 677 | 4/2002 | |
| FR | 2 192 592 | 2/1974 | |
| FR | 2552411 A1 * | 3/1985 | ..... 405/3 |
| FR | 2 755 661 | 5/1998 | |
| JP | 02241891 A * | 9/1990 | ..... 405/3 |

* cited by examiner

*Primary Examiner*—Lars A. Olsen
(74) *Attorney, Agent, or Firm*—Volpe & Koenig, P.C.

(57) ABSTRACT

A lifting arrangement for lifting boats 2 off the water and for putting boats 2 onto the water is provided, which comprises a crane 8, 9, 27 and pallets or cassettes 16 to be arranged under the hull of a boat 2 to be lifted or put down, connected to the crane. These lifting elements can be lowered below the floating boat, with preferably centering elements 41, 42 being provided for aligning the boat 2 in reference to a lifting element 16 positioned underneath.

13 Claims, 8 Drawing Sheets

LIFT ARRANGEMENT FOR BOATS

BACKGROUND

The invention relates to a lift arrangement for lifting boats from the water and for putting boats onto the water according to the preamble of claim 1.

Being relatively small water crafts, boats are frequently lifted from the water in order to be stored dry or to be transported over land to another lake or another coastal area, for example. Conventionally, it has been known to lift boats from the water via a rope winch and to pull them onto the shore, where they are placed onto a boat trailer or the like.

Sport boats of larger sizes and higher weights as well as fishing boats are sometimes lifted from the water via a crane. For this purpose, conventional load cranes in a harbor are used, from which two or more belts are suspended. The belts are arranged under the hull of the boat to be lifted so that it can be lifted by the crane out of the water and be put down on land, preferably onto a boat trailer. It is obvious that this lifting of a boat using belts is a time and personnel consuming ordeal, which bears risks because the boat hull hardly provides any resistance against any slippage of the belts in the longitudinal direction of the boat due to its streamlined shape and therefore the belts have to be aligned and exactly positioned in reference to the center of gravity of the boat.

Nevertheless, lifting a boat out of the water is frequently performed with a crane located in an inner harbor, because the land based traffic connection of a harbor and the availability to traffic of a harbor quay is frequently uncertain, while pulling a boat from the water via a rope winch is possible at naturally formed bank slopes only.

SUMMARY

The present invention is therefore based on the objective of improving a lifting arrangement of the type mentioned at the outset with regard to its manageability and handling.

The objective is attained by a lifting arrangement with the features of claim 1. Preferred embodiments of the lifting arrangement according to the invention are explained in claims 2 through 16.

Therefore, the central idea of the present invention comprises the use of pallets or casings as lifting elements. Contrary to conventionally known belts, support constructions are therefore used, which due to their inherit stiffness ensure a reliable support of the boat to be lifted, while providing solid contact points for the crane so that it easily can be suspended and disconnected without having to estimate or to determine empirically the position of the center of gravity. Rather the center of gravity of the boat is merely to be located somewhere above the area spread by the contact points of the crane, which is ensured each time the projection of the boat is entirely located within said area, i.e. the pallet or casing is sufficiently large. The boat is then lifted by the crane according to the principle of a serving tray. Here, pallet and/or casing refers to any sufficiently stiff support structures, onto which a boat can be placed, on the one hand, and which can be fastened to a crane, on the other hand. Such a construction can also be embodied as a plate, a grill, a grid construction, or a tray or the like.

Lifting elements are useful, i.e. pallets or casings of the lifting arrangement according to the invention, having adjustable fasteners for adjusting to the bottom of various boats, which fasteners essentially preferably comprise adjustable supports. Of course, it is also possible to provide pallets or casings with universally usable fasteners, which require no adjustments, or to be equipped with fasteners and/or supports that are self-adjusting to the shape of the hull of the boat.

In particular, when the lifting elements are adjusted or to be adjusted individually to different boats or different types of boats it is advantageous for the lifting elements to be provided with fastening arrangements for an easy latching of support arms or support ropes of the crane. This way a quick change of the lifting element of the lifting arrangement according to the invention is easily possible.

The invention offers particular advantages when the lifting arrangement is embodied such that the side of the lifting elements facing the water can be lowered below the water line, namely below the keel of a boat to be lifted so that the boat can float or sail over the lowered lifting element. This means that the boat floats when set onto the water and is released from the lifting element and conversely can be sailed over the lifting element for positioning.

For this purpose it is particularly advantageous when at the side facing the water, centering arrangements for centering a boat sailed over a lowered lifting element are provided, with the boat becoming centered in reference to the lifting element. This centering ensures that the lifting element is correctly positioned simply by lifting it and that it is correspondingly supported during the further lifting of the lifting element so that the boat on the lifting element is quickly and securely lifted off the water. Therefore, a time-consuming manual positioning of the boat when lifting the lifting element can be omitted thereby.

The centering arrangement can be mounted on the lifting element itself, for example via rolls, which form a type of a centering funnel for the keel of the boat; however, it is particularly advantageous when the centering arrangement essentially comprises sliders that can symmetrically approach the exterior hull of the boat from starboard and port-side. Such sliders ensure the central alignment of the keel of the boat over the lifting element in a simple manner, particularly even with different width boats.

If additionally a centering stop is provided for the bow of the boat, the boat can furthermore be aligned in its longitudinal direction over the lifting element by the boat simply sailing into the centering stop.

In addition to the area defined by the lowered lifting element in the projection onto the water surface, a gangplank can be arranged above the water level. This gangplank then allows a comfortable entering and exiting into and/or out of the boat immediately after setting it onto the water and/or prior to lifting it off the water, i.e. at a time when the boat requires no more steering and movement.

In order to adjust to different water levels by the tides and/or based on the tide flow varying water levels the just mentioned gangplank can be embodied floating. Preferably, the gangplank is mounted together with the centering arrangement at the common, floating fastener. This floating fastener is preferably provided with pontoons, which are mounted in a displaceable manner at the vertical supports of the crane, by which the vertical supports serve as vertical guides.

In order to further improve the safety and comfort of entering into and leaving the boat on the gangplank mounted on the lifting arrangement according to the invention, the gangplank can be provided with telescope or fan-like extendable bridge elements for approaching a boat centered in a lifting arrangement. These bridge elements are preferably operated simultaneously with the sliders of the centering arrangement. This measure increases the range of width of boats useable for the lifting arrangement according to the invention, because the gangplank itself can be constructed for very wide boats, with narrower boats then being entered via the bridge elements.

In order to keep boats suspended at the crane via the lifting arrangement according to the invention as stable as possible, the crane is preferably provided with a lifting structure, which comprises a multitude of support arms connected to one another. As soon as the support arms are mounted at the pallet or the casing, preferably by way of latching, a type of transportation cage is formed for the boat, so that it is protected in an optimized way.

The lifting elements can be mounted fixed, for a more easy handling on land, or provided with rolls that can be activated for driving, when necessary. A boat lifted off the water by the lifting arrangement according to the invention is then simply put on land together with the pallet or the casing, which then are driven off "manually" or can be brought into a desired position.

Particular advantages therefore result when a lifting element is embodied in the form of cassettes of a mechanized shelf or honeycomb storage facility or the like. The mechanized shelf or honeycomb storage facility comprises transportation arrangements installed in a fixed manner for the placement or removal of boats held on the cassettes, with a stand-by station being provided, onto which the cassettes are placed by the crane using the lifting arrangements according to the invention and from which the cassettes with or without the boat can be picked up by the transportation arrangement of the shelf or honeycomb storage facility. Due to the limited space available at watersides and popular coastal areas, frequently there is a lack of docking spaces for boats. The present embodiment of the invention allows the use of an established storage technique for large and heavy objects that cannot be moved manually, which is used in other fields, in particular in steel trading, i.e. a shelf or honeycomb storage facility with the respective shelf control arrangement and horizontal transportation arrangements for the storage and removal of boats as well. The boats are here lifted off the water by the lifting arrangement according to the invention, after which by the transportation arrangements of the mechanized storage facility they are put into a storage space, i.e. in particular a shelf or a honeycomb of a honeycomb storage. Due to the fact that such a storage allows the arrangement of several storage spaces on top of one another as well as to establish the storage spaces at a certain distance from the shore, considerably more boats than before can be stored in a certain section of the seaside and kept available due to the mechanized transportation arrangements. Furthermore it is possible to cover this storage with a roof or to arrange it inside a warehouse, which offers the advantage that the boats are not subject to weathering and particularly UV-rays of the sun during the time they are stored and kept readily available. Additionally, a warehouse improves protection from theft and vandalism.

When the lifting elements are embodied as cassettes of a mechanized shelf or honeycomb storage facility, a boat can automatically be placed onto the cassette while still being in the water, be lifted together with it off the water, and be transferred to the transportation arrangements, after which it is stored in a boat storage space in the shelf or honeycomb storage facility. Conversely, when required the transportation arrangements fetch the boat on its cassette in the storage space out of said storage and put it into the water so that it can be used. Based on the cassettes provided according to the invention, boats of different dimensions and shapes up to a maximum size and a maximum weight can be transported as well as stored and removed without the transportation arrangements or the boat storage spaces having to be embodied adjustable to the various shapes of the boats. Rather, the transportation arrangements and the boat storage spaces have to merely serve for transporting and accepting identically embodied cassettes.

The crane of the lifting arrangement according to the invention can finally be embodied such that it can span a longer distance in a linearly displacing manner, and this way, for example, it can lift a boat off the water and drive it over a multi-lane coastal highway or train tracks and put it behind them on land. A lifting arrangement according to the invention can also be used at places where previously no access to water was available, at least not for boats.

BRIEF DESCRIPTION OF THE DRAWINGS

In the following, an exemplary embodiment of the present invention is shown and explained in greater detail using the attached drawings. They show.

DETAILED DESCRIPTION OF THE PREFERRED EMBODIMENTS

Figure 1:
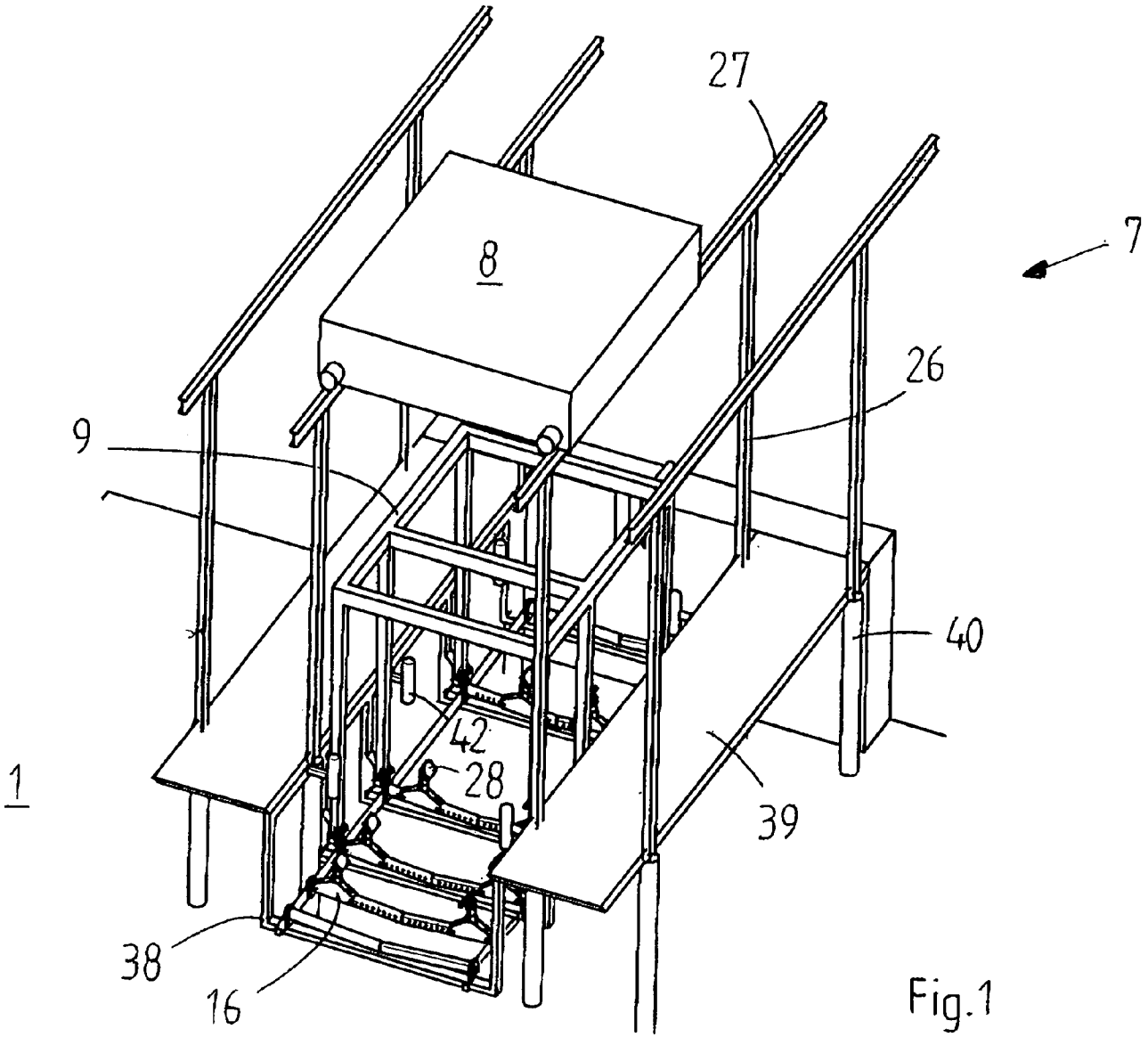
FIG. 1 a perspective view of a lifting arrangement according to the invention.
Figure 2:
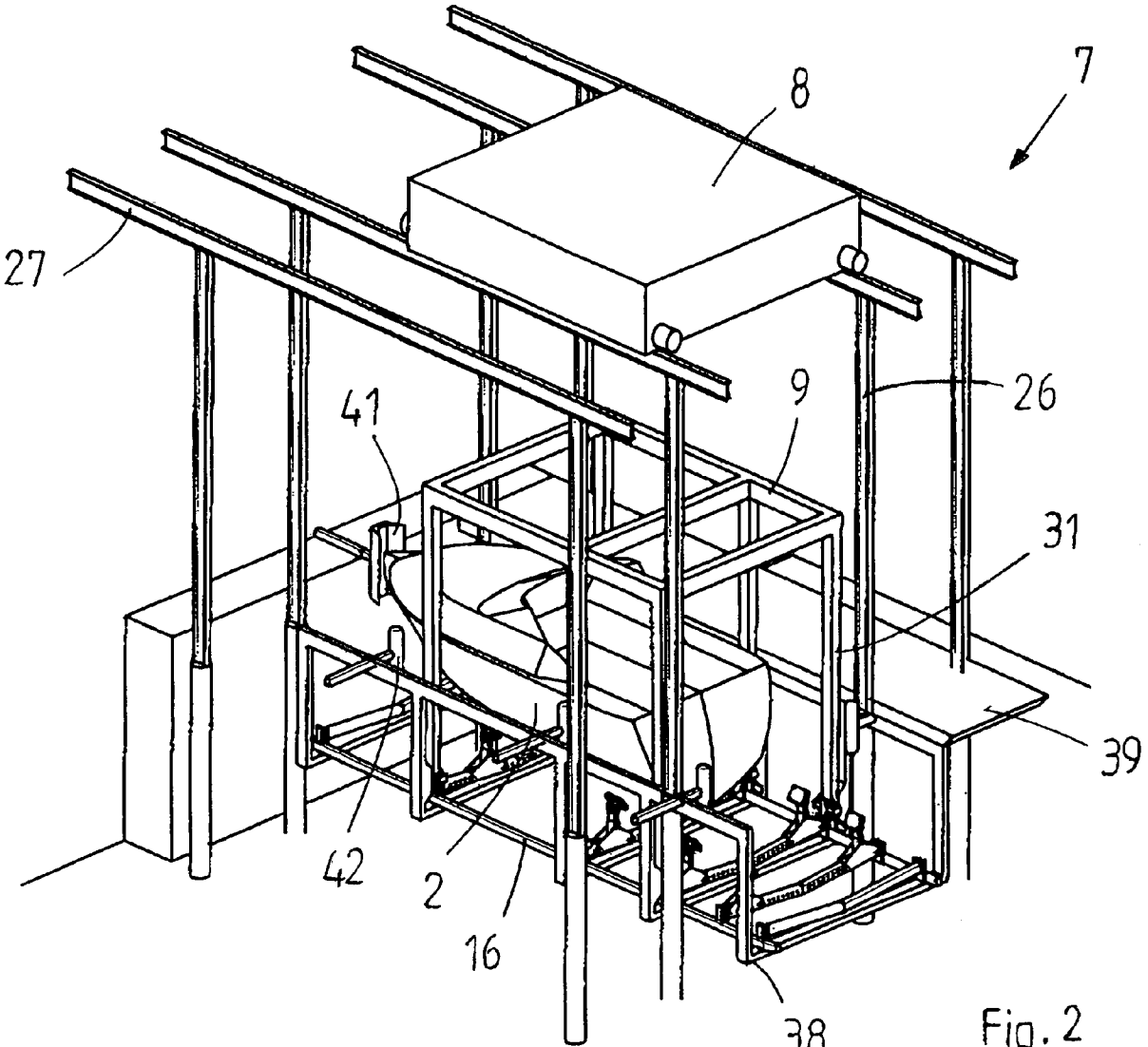
FIG. 2 a lifting arrangement according to FIG. 1 with a boat.

In FIGS. 1 and 2 an exemplary embodiment of a lifting arrangement 7 according to the invention is shown schematically, with parts of the lifting arrangement 7 being removed in FIG. 2 for better illustration.

Figure 5:
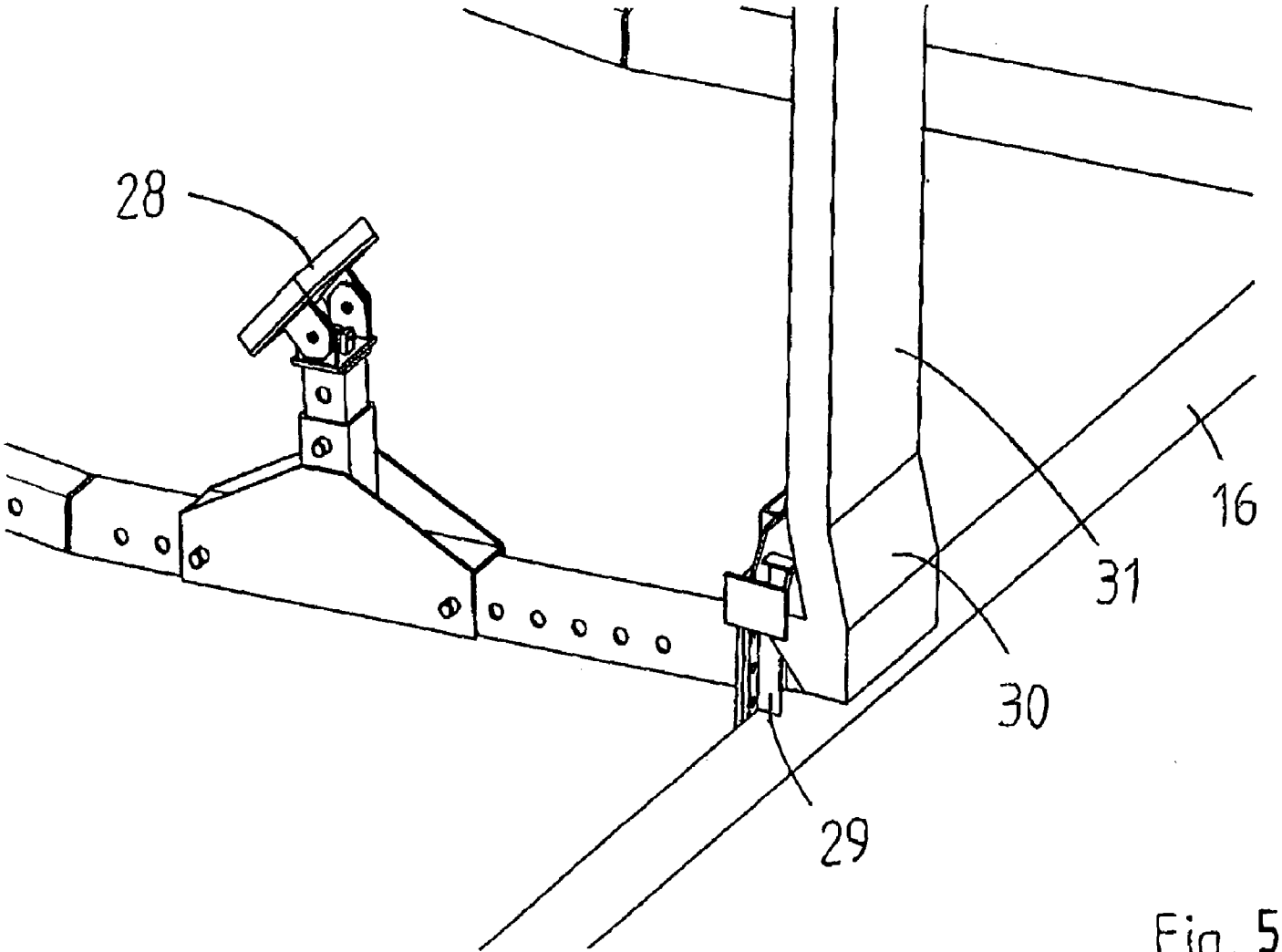
FIG. 5 a detail for mounting a cassette to the lifting arrangement.

Here, the lifting arrangement 7 comprises a crane embodied as a gantry crane 8 that can be displaced horizontally along a rail bridge 27, and from which a lifting structure 9 is suspended. The lifting structure 9 comprises a total of six support elements 31, which are latched via links 30, as shown in FIG. 5, in the mounting arrangement 29 of a cassette 16 of a mechanized storage facility. The supports of the gantry crane 8 serve as vertical guides 26 for pontoons 40, which hold a gangplank 39 as well as a stop 38 connected thereto for putting down the cassette 16.

In FIG. 1, the gantry crane 8 has lowered the lifting structure 9 suspended therefrom and the cassette 16 mounted thereto to the lower stop 38 below the water level. Due to the pontoons 40 and the floating guide of the gangplank 39 and the latch 38 at the vertical guides 26 the parts of the present exemplary embodiment facing the water automatically adjust to the water level in the inner harbor 1.

As illustrated in FIG. 2, at the height of the gangplank 39, at the front, a centering stop 41 for the bow of a boat 2 is provided. Laterally, in the height of the gangplank, a number of sliders 42 are arranged, which are displaceable symmetrically towards the center of the lifting arrangement 7 and this way center a boat 2 sailing into the lifting arrangement 7 over the cassette 16. Subsequently, the boat 2, centered in this manner, can be placed fittingly onto the cassette 16 by simply raising the lifting structure 9 and then be set down on land by another lifting by the gantry crane 6 and a displacement along a rail bridge 27.

Figure 4:
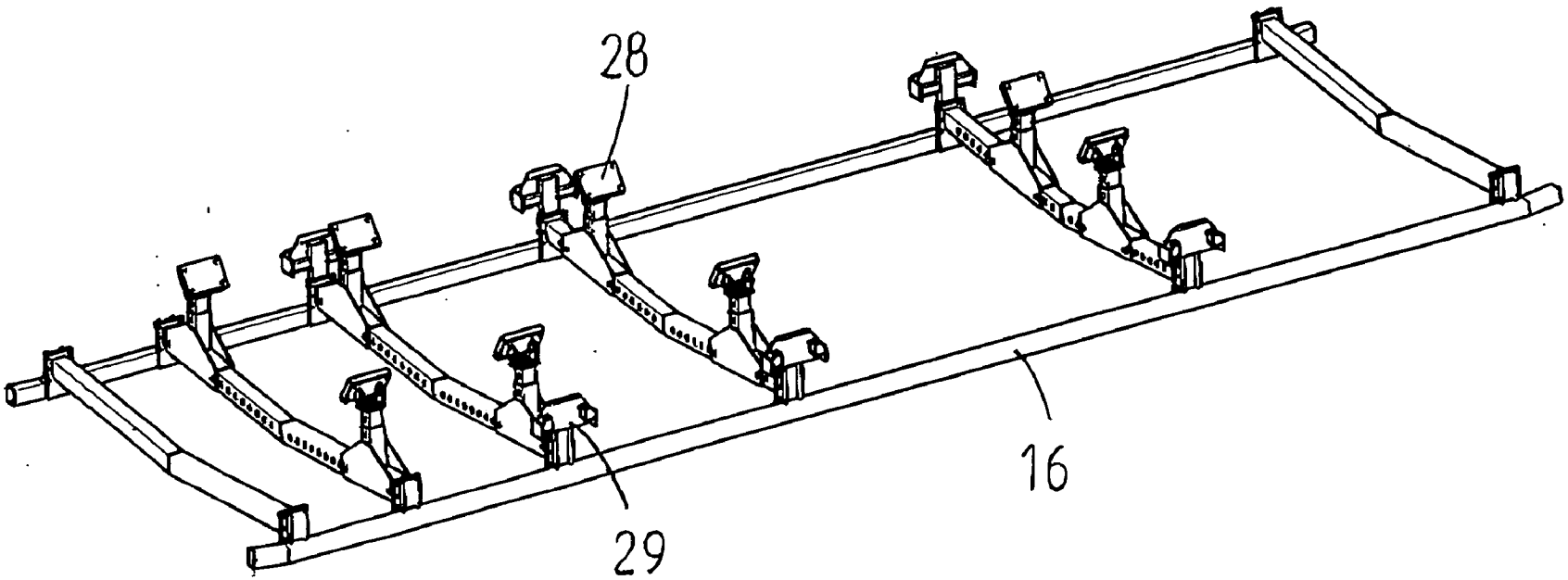
FIG. 4 a cassette in a perspective view.

As shown in FIG. 4, the cassette 16 essentially comprises a pipe structure with adjustable supports 28 mounted thereupon for the exterior hull of the boat 2. Laterally, mounting arrangements 29 are provided into which, as shown in FIG. 5, links 30 of the support elements 31 of the lifting structure 9 can be latched. For this purpose, the support elements 31 are preferably embodied displaceable in reference to the lifting structure 9 and/or embodied pivotal, namely outward in reference to the cassette 16.

Figure 3:
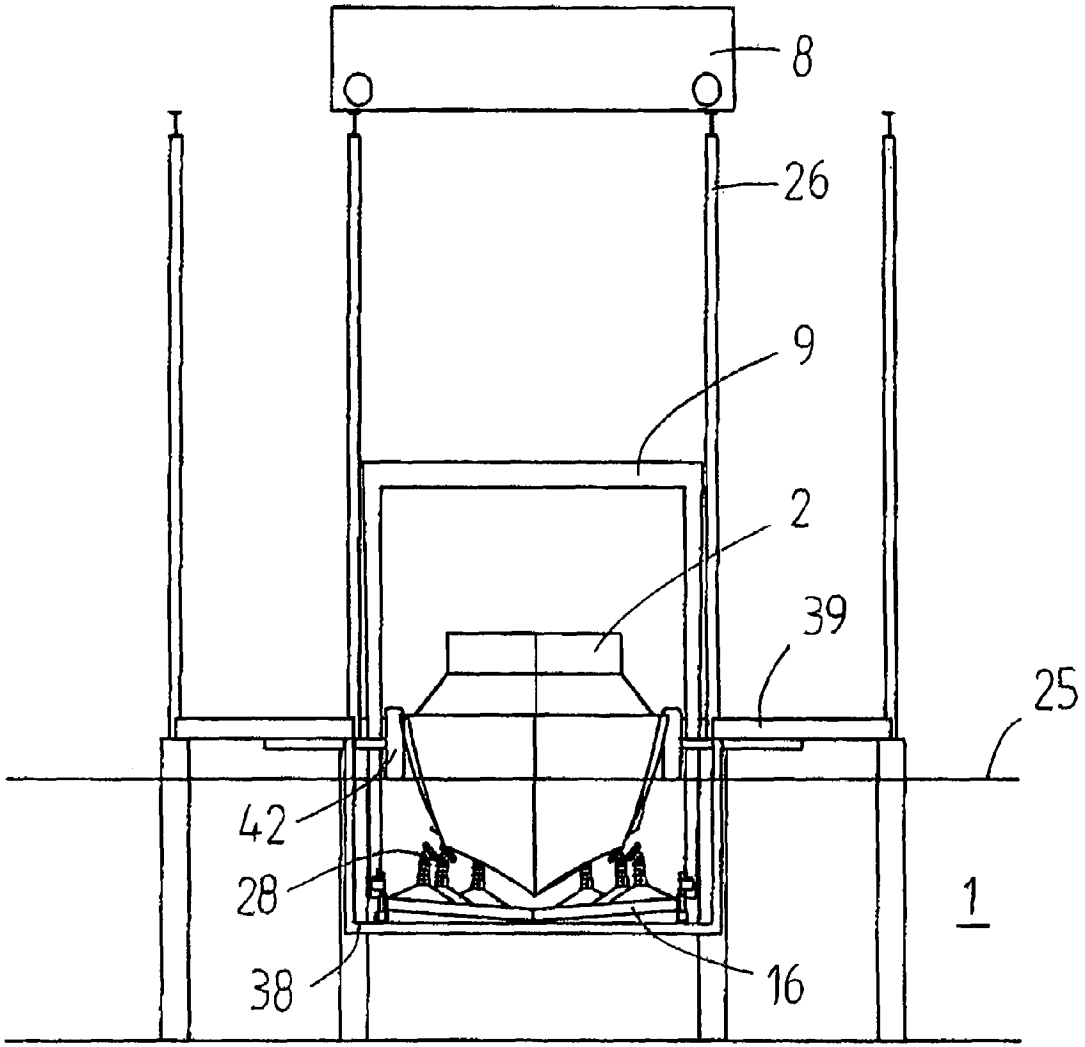
FIG. 3 a schematic front view of the centering of a boat in the lifting arrangement.

In FIG. 3, schematically a frontal view of the lifting arrangement 7 is shown, in order to illustrate the centering of the boat 2 by the sliders 42. This centering finally leads to a clean placement of the boat 2 onto the supports 28 of the cassette 16 during lifting thereof via the lifting structure 9. The reference number 25 symbolizes the water level.

Figure 6:
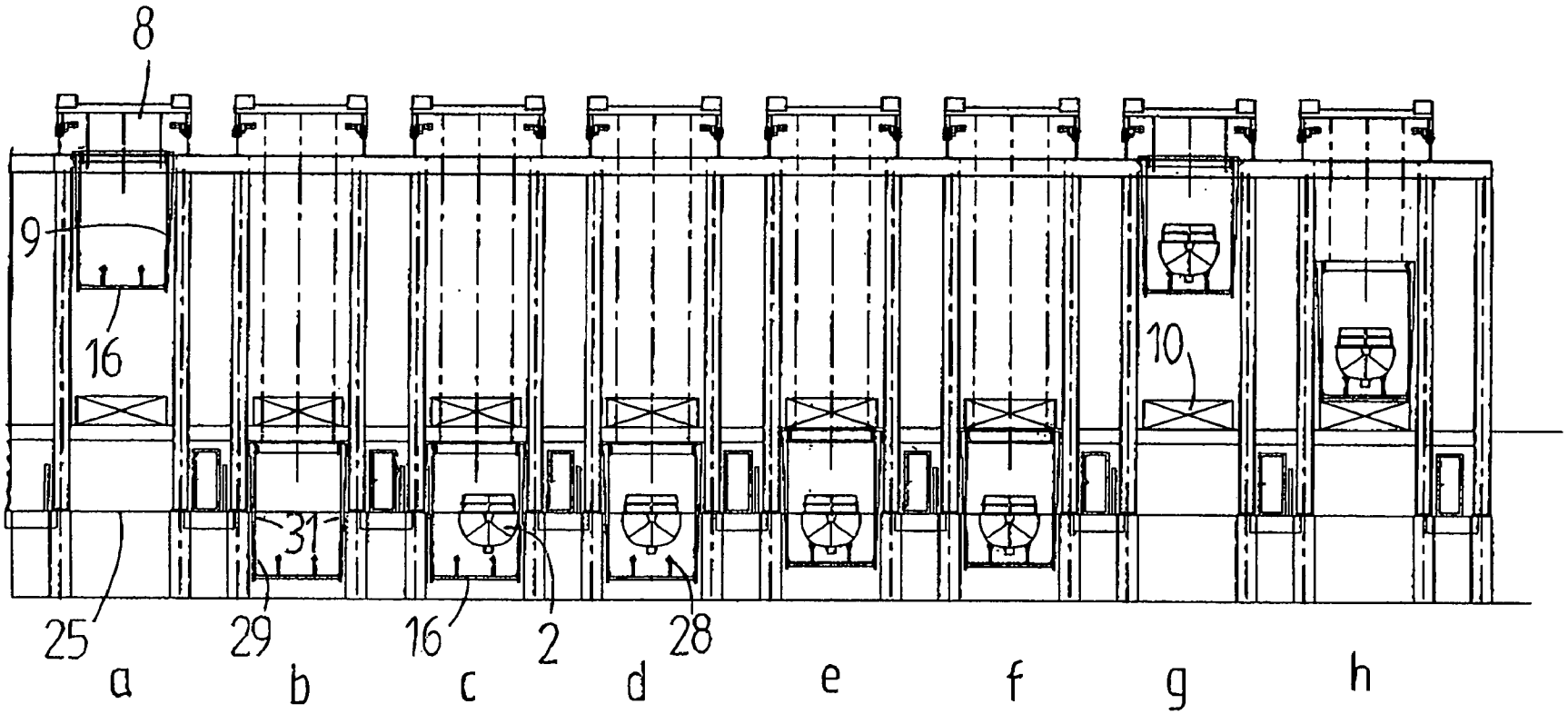
FIG. 6 a front view of eight lifting arrangements arranged side-by-side in various phases of the lifting process.

FIG. 6 shows the frontal view of eight lifting arrangements 7*a–h* arranged side-by-side, with each of said lifting arrangements 7*a–h* showing another phase of the lifting process of a boat 2. The lifting arrangement 7*a* is displacing a cassette 16 from the land side to the seaside, in order to fetch a boat 2 from the inner harbor 1. For this purpose, the support elements 31 of the lifting structure 9 are latched in the holding arrangements 29 of the cassette 16 and the lifting structure 9 is pulled all the way upward by the gantry crane 8. In the lifting arrangement 7*b* the lifting structure 9 with the cassette 16 has been lowered below the water level 25 down to the lower stop by the portal crane 8. Now, as shown by the lifting arrangement 7*c,* the boat 2 can sail over the cassette 15. In the lifting arrangement 7*d* a boat 2 has been centered by a centering arrangement (not shown here) so that the keel is positioned centered over the cassette 16. In the lifting arrangement 7*e* the gantry crane 8 has lifted the lifting arrangement 9 together with the cassette 16, until the supports 28 contact the hull of the boat. Then, in the lifting arrangement 7*f,* the gantry crane 8 begins to lift the cassette 16 together with the boat 2. As illustrated by the lifting arrangement 7*g,* in the lifted position the boat 2 can be displaced to the rear on its cassette 16 by the gantry crane 8 vertically to the drawing level and, as in the lifting arrangement 7*h,* put down on land onto a stand-by station 10. Here, the lifting structure 9 is latched off, and the cassette 16 can be removed and displaced therefrom together with the boat 2.

Figure 7:
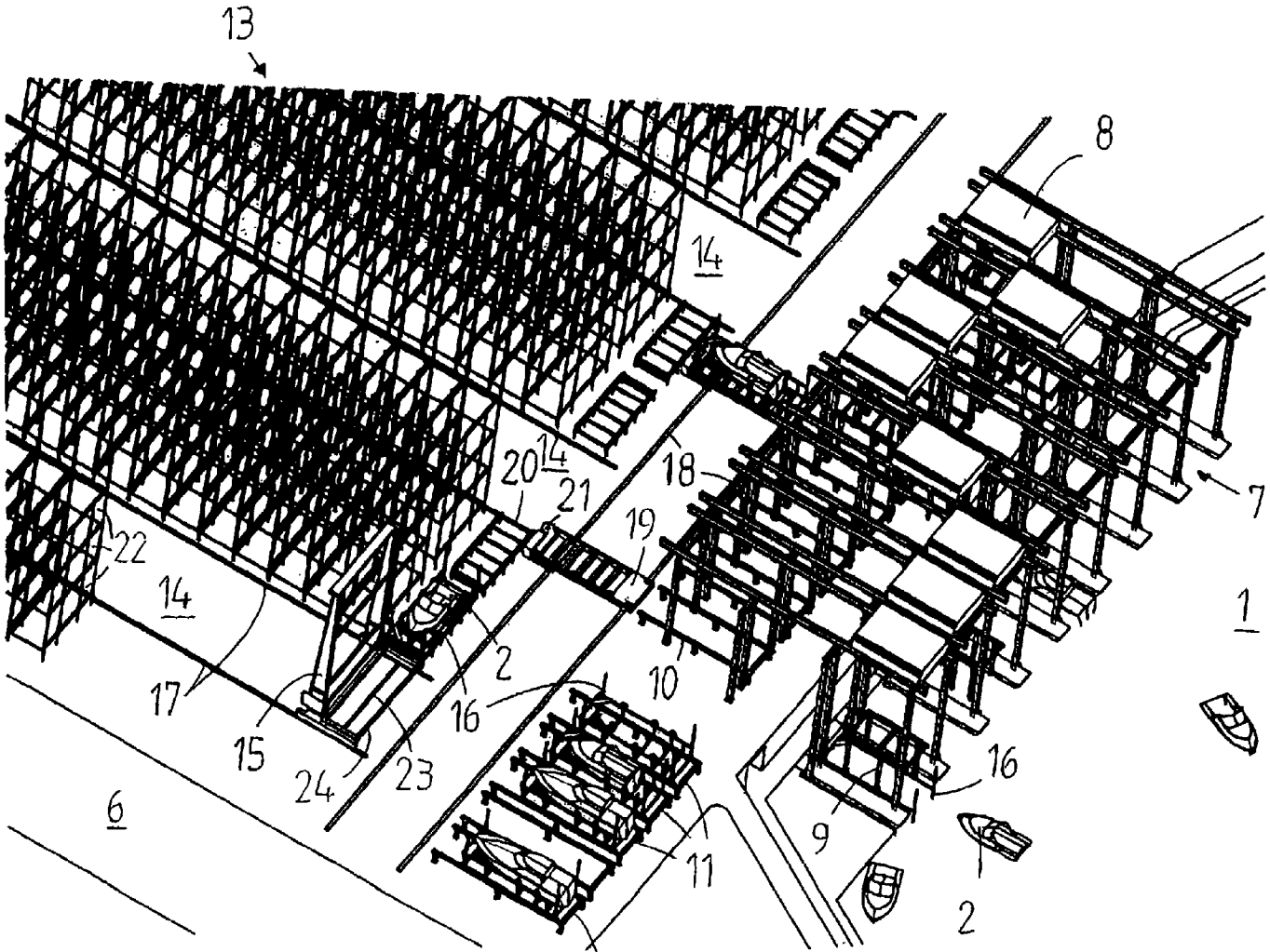
FIG. 7 a perspective view of a storage arrangement with a lifting arrangements according to the invention.

FIG. 7 shows in a perspective overview an example for an arrangement for the dry storage and stand-by of boats with eight lifting arrangements 7 according to the invention. The lifting arrangements 7 serve as interfaces between the inner harbor 1 and the honeycomb storage 13 having several shelf paths 14, in which a shelf operating arrangement 15, known per se, for inserting and removing cassettes 16 with boats 2 supported thereon can be displaced via rails 17 into and out of the individual honeycombs. In order to transport boats 2 on their cassettes 16 between the stand-by stations 10 of the lifting arrangements 7 and the shelf serving arrangement 15, there are displacing cars 19 provided, running on rails 18, which pull down the cassettes 16 with or without any boat along the stand-by stations 10 or can push it onto them, and transfer laterally or remove the cassettes 16 at the transfer stations 20 at the beginning of each shelf path 14, which transfer station 20 therefore serves as an interface for the shelf operating arrangement 15. For this purpose, the displacement car 19 is provided with a rotary arrangement 21, by which it is pivotal by 90°. In the honeycomb storage 13, four boat storage spaces 22 each are arranged on top of one another, which can be accessed by the shelf operating arrangement 15. A linear manipulator 23 pulls the cassette 16, positioned on the transfer station 20, together with the boat 2 onto the transportation structure 24 of the shelf operating arrangement 15 and pushes it conversely, when reaching the respective boat storage space 22, off the transportation structure 24 and into said storage space. The removal of a boat 2 or an empty cassette 16 function conversely.

The displacement cars 19 can put down any cassette 16 located in the arrangement with or without a boat 2 either on the service stations 11 or a storage station 12 as an interface between a driveway 6 and the arrangement shown, or retrieve it therefrom.

Figure 8:
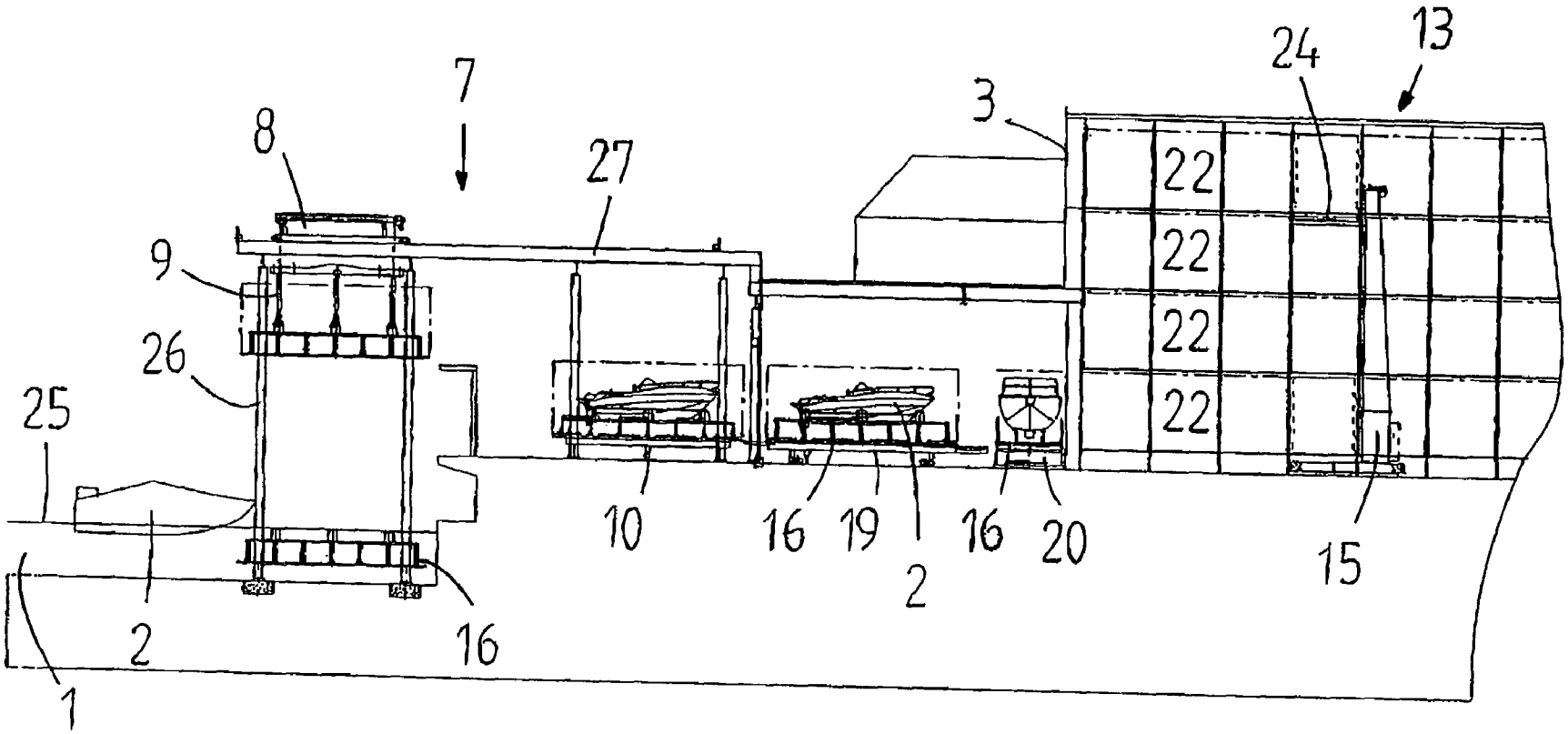
FIG. 8 a schematic side view of the arrangement according to FIG. 7.

In FIG. 8, the essential elements of the arrangement shown in FIG. 7 are shown schematically in a side view, with the progression of the storage of a boat being illustrated from the inner harbor 1 into the honeycomb storage facility 13, which is arranged in a warehouse 3 with sky light arrangements 4 and restaurant facilities. The boat 2 is displaced via a cassette 16, which has been lowered below the water level 25. Subsequently the gantry crane 8 of the lifting arrangement 7 according to the invention lifts the cassette 16 via its lifting structure 9 off the water within vertical guides 26, and displaces it linearly along a rail bridge 27 to shore, where the cassette 16 is lowered onto the stand-by station 10. Subsequently, the displacement car 19 pulls the cassette 16 along, away from the stand-by station 10, and displaces the cassette 16 laterally to the desired shelf path 14, where a pivoting of the displacement car 19 with the cassette 16 occurs by 90° and the cassette 16 is then pushed over the lateral side onto the transfer station 20 of the respective shelf path 14. From the transfer station 20 the shelf operating arrangement 15 removes the cassette 16 with the boat 2, again in the longitudinal direction, lifts it, and stores the boat 2 together with its cassette 16 lengthwise into a boat storage space 22 in the honeycomb storage facility 13.

The arrangement shown in FIGS. 7 and 8 is automatically operated by a central control. When a boat owner wants to sail with his/her stored boat 2 into the inner harbor 1, the control is correspondingly activated, which then fetches this very boat from its boat storage space 22. This occurs in that the respective shelf operating arrangement 15 pulls the boat 2 on its cassette 16 out of the boat storage space 22 onto the transportation structure 24, pushes it along a respective drive therefrom to the transfer station 20, where then a displacement car 19 accepts the cassette 16 with the boat 2 from the transfer station 20, rotates by 90°, displaces along the rails 18 up to lifting arrangements 7, and pushes here the boat 2 with the cassette 16 onto the stand-by station 10. From the stand-by station 10, the gantry crane 8 removes the cassette 16 with the boat 2 by lowering the lifting structure 9 to the cassette 16, the links 30 of the support elements 31 of the lifting structure 9 latching into the holding arrangement 29 of the cassette 16, and the boat then being displaced along the rail bridge 27 down to the stop of the portal crane 8 facing the water. There the cassette 16 is lowered to the stop 38, with the boat 2 floating on the water surface 25 and thus it is released from the cassette 16. Then, it can sail into the inner harbor 1 on its own accord. In between, the boat owner has waited near the gangplank 39 and can enter his boat 2 here from the lifting arrangement 7.

Generally, after sailing the boat 2 out of the lifting arrangement 7, the cassette 16 is again returned in the opposite direction into the honeycomb storage 13, with the cassette 16 then being able to return in a predetermined boat storage space 22, if one such has been identified, however that is not necessary, as long as the control remembers where the cassette 16 has been put down.

When the boat 2 returns, it is automatically identified by the control or the boat owner identifies himself at a control interface for the control, so that then the corresponding cassette 16 can be retrieved from the honeycomb storage 13 and again be lowered until below the water level 25 on the water side of the lifting arrangement 7 and in particularly lower than the keel of the boat 2. The boat 2 is then sailed or floated over the cassette 16 and, after the captain has left via the gangplank 39 and the centering arrangement having been activated via the slide 42 is exactly centered over the cassette 16. Subsequently the cassette 16 is lifted by the gantry crane 8 and stored in the reverse sequence as described above in a boat storage space 22 in the honeycomb storage facility 13. Here, it is not necessary for it to be a permanent boat storage space 22.

For maintenance purposes the control can also be switched off, in order to fetch a certain boat 2 from the honeycomb storage facility 13 and to put it onto a service station 11.

List of Reference Characters

1 inner harbor
2 boat
3 warehouse
4 sky light arrangement
5 restaurant facility
6 drive way
7 lifting arrangement
8 gantry crane
9 lifting structure
10 stand-by station
11 service station
12 storage station
13 honeycomb storage
14 shelf path
15 shelf operating arrangement
16 cassette
17 rails
18 rails
19 displacement car
20 transfer station
21 rotary station
22 boat storage space
23 manipulator
24 transportation structure
25 water level
26 vertical guide
27 rail bridge
28 support
29 holding arrangement
30 link
31 support element
32 stop
33 gangplank
34 pontoon
35 centering stop
36 slider

The invention claimed is:

1. A lifting arrangement for lifting boats off the water and putting boats onto the water, comprising a crane (8, 9, 27) and a lifting element that can be connected to the crane and can be arranged underneath a hull of a boat (2) to be lifted or put down, the lifting element comprises a pallet or a cassette (16) wherein the lifting element (16) facing the water can be lowered below a water line (25) and below a keel of the boat (2) to be lifted, so that the boat (2) can sail over the lowered lifting element (16), at a side facing the water, the lifting arrangement is provided with a centering arrangement (41, 42) for centering the boat (2), that has sailed over the lowered lifting element (16), in reference to the lifting element (16), and the centering arrangement also comprises a centering stop (41) for a bow of the boat (2).

2. A lifting arrangement according to claim 1, wherein the lifting element (16) is provided with adjustable holders (28) for adjusting to bottoms of different boats (2).

3. A lifting arrangement according to claim 2, wherein the holders of the lifting element (16) comprise adjustable supports (28).

4. A lifting arrangement according to claim 1, wherein the lifting element (16) is provided with holding arrangements (29) for latching to support arms (31) or support ropes of the crane (8, 9, 27).

5. A lifting arrangement according to claim 1, wherein the crane (8) includes a lifting structure (9) comprising a number of support arms (31) connected to one another.

6. A lifting arrangement for lifting boats off the water and putting boats onto the water, comprising a crane (8, 9, 27) and a lifting element that can be connected to the crane and can be arranged underneath a hull of a boat (2) to be lifted or put down, the lifting element comprises a pallet or a cassette (16), wherein the lifting element (16) facing the water can be lowered below a water line (25) and below a keel of the boat (2) to be lifted, so that the boat (2) can sail over the lowered lifting element (16), at a side facing the water, the lifting arrangement is provided with a centering arrangement (41, 42) for centering the boat (2), that has sailed over the lowered lifting element (16), in reference to the lifting element (16), and the centering arrangement comprises sliders (42) that can symmetrically approach an exterior hull of the boat (2) from starboard and port-side.

7. A lifting arrangement for lifting boats off the water and putting boats onto the water, comprising a crane (8, 9, 27) and a lifting element that can be connected to the crane and can be arranged underneath a hull of a boat (2) to be lifted or put down, the lifting element comprises a pallet or a cassette (16), wherein the lifting element (16) facing the water can be lowered below a water line (25) and below a keel of the boat (2) to be lifted, so that the boat (2) can sail over the lowered lifting element (16), at a side facing the water, the lifting arrangement is provided with a centering arrangement (41, 42) for centering the boat (2), that has sailed over the lowered lifting element (16), in reference to the lifting element (16), and next to an area defined by the lowered lifting element (16) in projection to the water surface a gangplank (39) is arranged above the water surface.

8. A lifting arrangement according to claim 7, wherein the gangplank (39) floats in order to adjust to varying water levels.

9. A lifting arrangement according to claim 8, wherein the centering arrangement (41, 42) and the gangplank (39) are mounted at a common, floating holder (40).

10. A lifting arrangement according to claim 9, wherein the crane (8) is provided with vertical supports, which serve as the vertical guide (26) of a holder for the gangplank (39) and the centering arrangement (41, 42), with pontoons being provided at the vertical guides (26).

11. A lifting arrangement according to claim 10, wherein the gangplank (39) is provided with bridge elements for approaching the boat (2), centered in the lifting arrangement (7), in a telescoping manner.

12. A lifting arrangement for lifting boats off the water and putting boats onto the water, comprising a crane (8, 9, 27) and a lifting element that can be connected to the crane and can be arranged underneath a hull of a boat (2) to be lifted or put down, the lifting element comprises a pallet or a cassette (16), wherein the lifting elements (16) are provided with driving wheels that are controllable and activated when needed or are mounted fixed.

13. A lifting arrangement for lifting boats off the water and putting boats onto the water, comprising a crane (8, 9, 27) and a lifting element that can be connected to the crane and can be arranged underneath a hull of a boat (2) to be lifted or put down, the lifting element comprises a pallet or a cassette (16), wherein the lifting elements comprise cassettes (16) of a mechanized shelf or honeycomb storage facility (13) having fixed installed transportation arrangements (15, 19) for loading and removing boats (2) held on the cassettes (16), with a stand-by station (10) being provided, on which the cassettes (16) can be put down by the crane (8) of the lifting arrangement (7), and which can be approached by transportation arrangements (19) of the shelf or honeycomb storage facility (13).

* * * * *